United States Patent [19]

Daniels et al.

[11] 4,348,590

[45] Sep. 7, 1982

[54] X-RAY TUBE ANODE VOLTAGE COMPENSATOR

[75] Inventors: Herbert E. Daniels, Brown Deer; Harold E. Stehman, Hales Corners; Brian P. Moran, Mukwonago, all of Wis.

[73] Assignee: General Electric Company, Schenectady, N.Y.

[21] Appl. No.: 200,644

[22] Filed: Oct. 27, 1980

[51] Int. Cl.[3] ..... H05G 1/32; H05G 1/34

[52] U.S. Cl. ..... 378/112; 378/115

[58] Field of Search ..... 250/409, 408

[56] References Cited

U.S. PATENT DOCUMENTS 3,521,067 7/1970 Splain ..... 250/408

3,631,527 12/1971 Splain ..... 250/409

4,177,406 12/1979 Hermeyer et al. ..... 250/409

*Primary Examiner*—Alfred E. Smith

*Assistant Examiner*—T. N. Grigsby

*Attorney, Agent, or Firm*—Ralph G. Hohenfeldt

[57] ABSTRACT

A system for supplying a selected voltage between the anode and cathode of an x-ray tube independent of power source voltage variations couples the x-ray tube power supply to the source with a transformer whose output voltages are selectable with tap switches. Prevailing source voltage and selected applied voltage are sensed and represented by analog signals which are converted to binary digital codes that form addresses for a read-only memory. The read-only memory is programmed with data representative of the pattern in which the tap switches should be set for the transformer to supply the selected voltage at the prevailing source voltage. When addressed by combinations of code words representative of the selected and source voltages, the memory outputs a code word that is used to set the switches in the corresponding pattern.

6 Claims, 2 Drawing Figures

X-RAY TUBE ANODE VOLTAGE COMPENSATOR

BACKGROUND OF THE INVENTION

This invention relates to diagnostic x-ray apparatus and, in particular, to a system for compensating the kilovoltage applied between the anode and cathode of an x-ray tube during an exposure for power supply voltage variations. The new compensating system is especially useful in mobile x-ray units which use battery power supplies whose output voltage declines as the battery discharges but as will be evident hereafter, the system can also be used to compensate for line voltage variations in cases where the x-ray unit is supplied from the ac power lines in a building.

In most mobile x-ray units, batteries supply dc power to an inverter and the ac power output from the inverter is fed to an autotransformer to which the primary winding of a step-up x-ray tube anode supply transformer is connected. The ac output voltage from the secondary of the transformer is rectified and applied between the anode and cathode of the x-ray tube during an exposure. In prior art systems, before an x-ray exposure was made, the operator was required to observe a battery charge condition indicating meter and then manipulate a control which changed taps on the autotransformer windings, that is, the turns ratio of the autotransformer was changed, to yield an ac output voltage that was compensated for the source voltage, such as the battery voltage, being below fully charged level. This procedure allows possible human error to enter into battery voltage compensation.

Some rather sophisticated general purpose source voltage variation compensators have been developed which use digital logic techniques and which could be applicable to x-ray power supply voltage compensation. For example, U.S. Pat. No. 3,818,321 discloses a circuit wherein the ac voltage on the secondary of a power supply autotransformer is sampled and converted to a dc analog signal which is, in turn, converted to an equivalent digital value or code. The number of winding turns are controlled by controlling closure of one tap switch at a time in a digital fashion. Each tap switch corresponds to a unique count in a digital counter. The regulated voltage is compared with several reference voltages defining the regulation range. The comparison results are used in discrete steps to control the counts in the counter and thereby control closure of a particular switch so that the controlled voltage is between the reference voltage limits which occurs only when the regulated voltage is within the desired range. Complexity is one of the disadvantages of this system.

A variety of other voltage regulating systems for x-ray tube power supplies have also been developed which use digital logic techniques. Typically, these are based on use of a microprocessor. Signals representative of the voltage which the operator desired to have applied between the anode and cathode of the x-ray tube for making an exposure are fed to a microprocessor which executes a program that results in switching procedures being carried out for sending the proper applied voltage to the x-ray tube transformer. Systems of this kind, however, depend on independent means for regulating the supply voltage. They do not provide a simple means for compensating for source voltage variations automatically in coordination with the operator simply selecting the voltage which is desired to be applied to the x-ray tube for an exposure.

SUMMARY OF THE INVENTION

In accordance with the invention, the input voltage which is supplied to the primary winding of the high voltage step-up x-ray tube transformer is obtained from an autotransformer which is fed from an unregulated source such as the power lines in a building or, in a mobile x-ray unit, from an inverter that is powered by a rechargeable storage battery. In the illustrated embodiment, several tap switches, which are controlled by electroresponsive means such as relays, are used to variously connect winding sections of the autotransformer to control its output voltage. The switches are operated in various combinations to obtain output voltages throughout the required kilovoltage range which is applied to the x-ray tube. Source voltage level data is obtained with a comparator or level detector. The analog output signals of the level detector representative of source voltage are converted to a multiple bit code, such as a 3-bit code which represents source voltage. This code is combined with another code, such as a five-bit code which is produced by the operator operating a kilovoltage (kv) selection switch. The resultant combined multiple bit or 8-bit code in the illustrative embodiment, then represents the selected kilovoltage and present source voltage, with a unique pattern for each of many possible kv settings. Three and five bit code combinations can, for example, represent 8 battery voltage levels and 32 selected kv levels. The combined codes are addresses to a read-only memory which converts the combined code words to a binary word which represents the proper tap switch select pattern for obtaining the corresponding kv output for each predetermined source voltage as defined by the combination code. The switching pattern is applied to a bank of switch drivers and the compensated kv selection is made at the autotransformer by the appropriate switches. The compensation program contained in the read-only memory is, when a battery power supply is used, derived through experimentation with each kv selection and battery level combination considered independently. In a commercial embodiment, the memory is a programmable read-only memory, (PROM) which contains four compensation programs each of which is slightly offset from the other in order to accomodate the variations from unit to unit. The program which yields the most accurate compensation is selected during calibration.

A primary object of the invention is to provide a simple and inexpensive system for compensating an x-ray tube high voltage power supply for source voltage variations automatically, that is, without requiring any involvement by the operator except selection of the kilovoltage which is desired to be applied between the cathode and anode of the x-ray tube.

Another object is to implement the compensation function by way of software, that is, by simply programming a PROM in a manner that allows direct implementation of the required function from experimental data without requiring repeated hardware design.

Still another object is to provide a system wherein independence of each kv setting or selection and battery voltage combination allows implementation of very complex compensation functions.

Yet another object is to provide a source voltage compensation system which may readily be adapted to use in x-ray apparatus which is powered from either a battery or alternating current power lines in a building.

How the foregoing and other more specific objects of the invention are achieved will be evident in the ensuing description of illustrative embodiments of the invention which will now be set forth in reference to the drawings.

DESCRIPTION OF A PREFERRED EMBODIMENT

Figure 1:
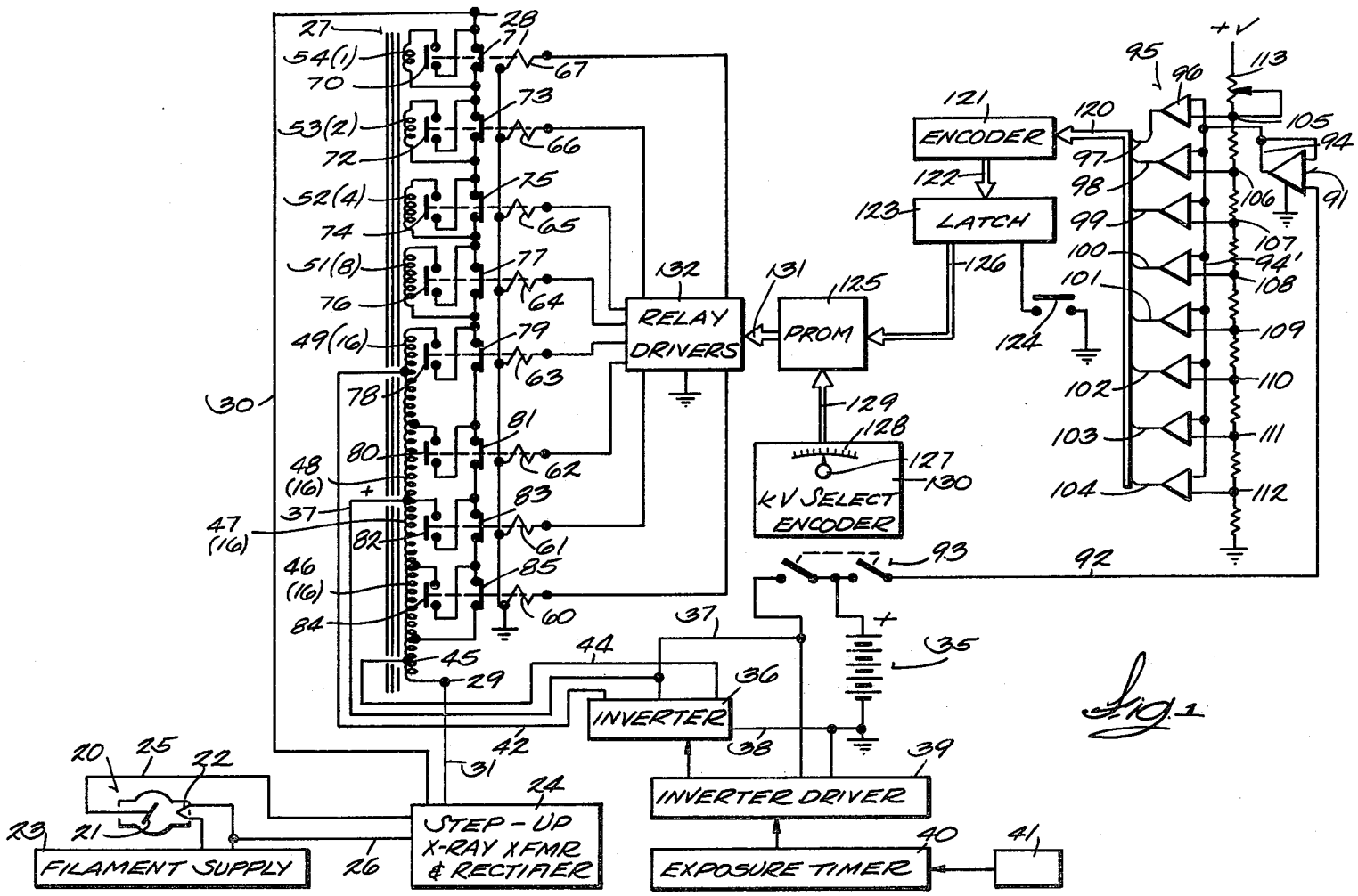
FIG. 1 is a combination block and partially schematic circuit diagram of an x-ray unit, such as a mobile unit, which uses a storage battery as a power source.

In FIG. 1, the x-ray tube whose anode to cathode voltage must correspond with the voltage selected by the operator for an exposure is designated generally by the reference numeral 20 and appears in the lower part of the figure. The tube is conventional in that it has an anode 21 and a cathode filament 22. The filament supply is represented symbolically by the block marked 23. The x-ray power supply is represented by the block marked 24 and includes a step-up transformer and rectifier for supplying kilovoltage, by way of lines 25 and 26 between the anode and cathode when an x-ray exposure is in progress. In this example, the primary winding of the step-up transformer is supplied with power from an autotransformer which is generally designated by the reference numeral 27. The autotransformer has a pair of output terminals 28 and 29 which are connected to transformer power supply 24 by lines 30 and 31 which are connected to the respective autotransformer terminals 28 and 29.

In the FIG. 1 embodiment, the power source for the x-ray unit is a battery 35. Typically, the no-load voltage on batteries used in mobile x-ray units may be around 121 volts when the battery is fully charged and will be considered useable until the battery discharges to the point where its no-load voltage is around 108 volts, for example. The no-load voltage usually decreases nonlinearly between fully charged condition and minimum acceptable voltage condition.

In FIG. 1 an inverter 36 is used for converting dc power from battery 35 to ac power for feeding autotransformer 27. The inverter is connected to the battery by means of supply lines 37 and 38 and it is operative to produce a 800 hz output voltage under the control of an inverter driver such as the one symbolized by the block marked 39. Suitable inverter systems are sufficiently well-known to those skilled in the electrical arts to obviate the need for describing the system in detail. The inverter is caused to initiate output of alternating current in response to signals received from an x-ray exposure timer which is represented by the block marked 40 and is activated by the operator's hand switch which is represented by the block marked 41.

The inverter has ac output lines 42 and 44 which connect to and supply alternating current to the winding sections of autotransformer 27 which act as primary windings.

Autotransformer 27 has a plurality of winding sections on its core which are marked 45 to 54. Where appropriate, there is a number in parentheses next to the reference numeral indicative of the winding section and this number in parentheses represents the number of turns in a winding section in this example. Thus, sections 46–49 are each indicated to contain 16 turns and winding sections 51, 52, 53 and 54 are indicated to contain 8, 4, 2 and 2 turns, respectively. Sections 51–54 are called minor sections or steps for convenience. Sections 46–49 are called major sections or steps. Note that the number of turns in sections 54 down to 51 coincide with the values of the least to the most significant bit, respectively, in a four-bit binary word. The major sections or steps 46–49 have a number of turns, namely 16, corresponding with the fifth most significant bit in a five-bit binary word. Note that the sum or total number of turns in the minor steps equals the number of turns in any of the major steps, namely 16, in any of the major sections or steps. It will be evident that during one-half cycle of inverter output voltage, current will flow from primary input line 42 through series connected winding sections 49 and 48 to common or dc line 37 and during the next half-cycle current will flow from line 44 through primary winding sections 46 and 47 to common line 37 for inducing voltage in those sections and other winding sections on the transformer core.

The various winding sections can be connected in or disconnected from a series circuit which extends between autotransformer output terminals 28 and 29. For this purpose a plurality of electroresponsive tap switch operating means such as relay coils 60–67 are provided. Each relay coil, when energized, drives a tap switch contact pair for selectively connecting a winding section in the series circuit between autotransformer output terminals or bypassing and disconnecting said section. For instance, relay coil 67 when energized will close switch contacts 70 which it controls and will simultaneously open switch contacts 71. It will be evident that with normally closed switch contact 71 being open and normally open switch contact 70 being closed due to energization of relay coil 67, winding section 54 will be in the series circuit between output terminals 28 and 29. By inspection of the drawing, one may see that each of the winding sections has a tap switch comparable to the one marked 70 for connecting that winding section optionally in series with other selected winding sections and that each section also has a switch comparable to tap switch 71 for bypassing the particular winding section while at the same time establishing circuit continuity between output terminals 28 and 29. It will be evident to those skilled in the art that the highest output voltage will be produced between autotransformer output terminals 28 and 29 when tap switches 71, 73, 75, 77 and 79 are open and tap switches 70, 72, 74, 76 and 78 are closed so as to put all of the winding sections in series between the output terminals. Of course, the source voltage compensating system which is about to be described connects winding sections in series as is required to produce a voltage across output terminals 28 and 29 which is directly proportional to the kilovoltage setting selected by the operator for the next x-ray exposure. Actually, the output voltage between terminals 28 and 29 is proportional to the selected x-ray tube kilovoltage since the output voltage is stepped up by the x-ray transformer and rectifier assembly 24 for being applied between the anode and cathode of the x-ray tube by way of lines 25 and 26.

The source voltage sensing and compensating circuitry will now be described. The prevailing voltage of battery 35 is obtained through an instrumentation amplifier 91 which has one of its inputs connected to battery 35 by way of line 92 and one of two swiches in a gang switch arrangement 93. A voltage appears on the output 94 which is proportional to battery voltage at all times. This sensed voltage is supplied to a comparator or voltage level detector which is generally designated by the numberal 95. The level detector is composed of several differential amplifiers such as the one marked 96 and the amplifiers have signal output lines which are marked 97–104, respectively. A resistor voltage divider comprised of resistors which are series connected at points 105–112. A variable resistor 113 is connected to positive power supply and is used for setting the threshold voltage of levels of comparator 95.

The analog signal on the output 94 of amplifier 91 representative of battery voltage, is coupled to a common line 94' to which the inverting inputs of amplifier 96 and the others in the chain connect. The potential on common line 94' depends on existing battery no-load voltage. For the highest battery voltage appearing on common line 94', all of the junction points 105 to 112 will be lower than the voltage on line 94' and the differential voltage will be high enough to trip amplifier 96 and all of the amplifiers depicted below it in the drawing in which case all of the outputs 97–104 would switch from high to low. Thus, all of the amplifier outputs 97–104 could be considered to be at binary zero so, in the example, and 8-bit binary number consisting of all zeros would be formed. When battery voltage is at its lowest acceptable value, at 110 volts, for instance, it may only exceed the potential at point 112 in the divider in which case the differential voltage between point 112 and common line 94' may be just sufficient to trip only the lowermost amplifier in the depicted chain such that only its output 104 will switch to binary zero and the remaining amplifier outputs will remain high or at binary 1. Thus, a binary word in the form of 01111111 will be formed. In this particular example, battery voltage is defined in eight two-vol increments from 110 to 124 volts and these two-volt increments are reflected as two kilovolt increments on the output of the step-up x-ray transformer. In the illustrative arrangement, 28 possible kv settings and the eight battery voltage steps results in 224 combinations of tap switch 70–84 operations.

In FIG. 1, the 8-bit binary word representing current battery voltage prior to an exposure is transmitted by way of an 8-line bus 120 to digital encoder 121 which, in the illustrated embodiment, is an 8-line to 3-line encoder. In other words, the level detector output is converted into a 3-bit code which represents present battery voltage and is outputted from encoder 121 on a 3-line bus 122. When the system is energized for making an x-ray exposure, battery voltage is sensed, encoded as described, and the voltage representative code is held in a register or digital latch which is represented by the block marked 123. When the circuit is in exposure preparation condition, a switch 124 closes to disable latch 123 from changing its stored value during an exposure.

The three-bit code representative of battery voltage constitutes part of an address to one of the stored programs in a PROM 125. The three-bit part of the address is fed to the PROM from the latch by way of a bus 126. The programs in PROM 125, when executed, operate the autotransformer tap switches selectively to produce an autotransformer output voltage which is compensated for the battery voltage being above or below a predetermined level. The other part of the address to PROM 125 is, in this example, a 5-bit binary code which represents the kilovoltage which the radiological technician desires to apply to the x-ray tube anode for making an exposure. Selecting kilovoltage is the only mental step that has to be performed by the operator. This is done by using a kilovoltage selector and encoder which is represented by the block marked 130. The operator turns a knob 127 to align a pointer with a scale 128 which is marked in terms of x-ray tube applied kilovoltage. The knob also drives an encoder, not visible, which outputs a 5-bit binary code word representative of the selected kilovoltage. The 5-bit word in this example is transmitted by way of a bus 129 and constitutes the other part of the address to a particular program in the PROM. Thus, in this example, the address is an 8-bit code that represents selected kv and present battery voltage level. The manner in which the PROM is programmed will be discussed later.

When PROM 125 receives an 8-bit code representative of present battery voltage and selected kilovoltage, it outputs an 8-bit binary word, in this example, by way of a bus 131 for selective activation of some relay drivers, represented collectively by the block marked 132. The relay drivers are selectively energized by those bits in the PROM word which are in a high state or at binary 1. This results in those relays in group 60–67 being energized which will set the autotransformer tap switches in a position to produce an output voltage across terminals 28 and 29 and, hence, the proper selected kilovoltage on the x-ray tube for whatever battery voltage prevails at the time. It will be evident that when battery voltage is low, a greater number of turns in the secondary part of the autotransformer will have to be tapped in order for the selected x-ray tube kilovoltage to be achieved.

Whenever the autotransformer is energized from the inverter, there will be a minimum number of primary turns conducting as is evident from inspection of FIG. 1 where the turn group 45 is conducting through all of the normally closed switches 71, 73, 75, 77, 79, 81, 83, and 85 being closed. One may see that by various patterns of relay or electroresponsive switch operating means energizations, various pairs of cooperating switches such as 70, 71 and 78, 79 and 84, 85 may be closed and opened respectively to insert additional secondary winding sections into the series circuit between output terminals 28 and 29 or to remove winding sections from between said terminals to cause the output voltage from the transformer to be raised and lowered. If, for example, the PROM 125 outputs a digital word such as 00100111, relay coils 63, 65, 66 and 67 will be energized. Energization of relay 62 will put windings 46, 47 and 48, acting in the circuit between the output terminals by virtue of the switch contacts driven by this relay switching from the positions in which they are shown to opposite positions. Energization of relay coils 65, 66 and 67 will insert the secondary winding sections 52, 53 and 54 in the series circuit between the output terminals along with the winding sections previously mentioned. The three major steps, that is, windings 46, 47 and 48 which in this example each contain 16 turns will then have added to them four turns from section 52, two turns from section 53 and one turn from section 54. In most cases, it is only the minor 1, 2, 4 and 8 turn sections 54, 53, 52 and 51 which will need to be switched.

The manner in which the PROM 125 is programmed will now be discussed. Before doing that, however, the reader should be aware that total compensation of the kilovoltage for battery voltage variations must take into consideration variations in other electrical conditions for making x-ray exposures at different voltages and different x-ray tube currents. For instance, if the x-ray tube current is selected to be high, transformer leakage fluxes and impedances and other factors in the circuitry vary depending on load current and voltage levels such that there is a nonlinear relationship between battery voltage and the amount of compensation that is required and obtained by switching relay operated switches to produce a transformer output voltage that will result in the kilovoltage applied to the x-ray tube agreeing with that which has been set by the kv selector and encoder 130.

Thus, programming the PROM is an experimental procedure which starts with setting the battery voltage at a level which corresponds with the lowest level which the operative battery is allowed to discharge to when the x-ray unit is in the field. At this battery voltage, all permutations of relay switch openings and closings are made and an x-ray exposure is made for each permutation. For each x-ray exposure, that is, with the x-ray tube conducting current, the voltage applied to the x-ray tube with the particular relay combination is recorded as is the battery voltage and the relay combination or pattern. The battery voltage is then set a little higher, two volts higher, for example, and the kv and relay pattern for each relay permutation is recorded. This procedure is repeated for battery voltage steps up to the maximum obtainable battery voltage. When all of this data is obtained, programming the PROM can be undertaken. The manner in which PROMs are programmed is described in the manufacturer's literature and need not be discussed in detail here. Basically what one is doing is to look at every battery voltage and related kv selection in the collected experimental data and then to open the proper circuits in the PROM to cause it to produce a specific coded bit pattern for the particular voltage and kv selection so that the two-part address set up by the encoder 121 and the kv selector 130 will constitute a unique address to the PROM for obtaining an output word which will cause the selected kilovoltage to be applied to the tube by virtue of the proper relays being operated. To take a specific example, let us say that 85 kilovolts on the x-ray tube is desired for a battery voltage of 112 volts. The data would be searched to find where 85 kilovolts was measured when the battery voltage was 112 volts and the relay combination to get 85 volts would also be noted. At that location in memory the set-up is made which provides the relay setting for producing 85 kv on the x-ray tube for a battery voltage of 112 volts. So one can program every kilovoltage at every battery voltage so that unmeasurable variables in the circuitry need not be taken into account.

In a commercial embodiment, several compensation programs are contained in one or more PROMs and each of them is derived through experimentation with each kv selection and battery level combination considered independently. For instance, the actual PROM contains four compensation programs, each slightly offset from the others in order to accommodate for variations between different x-ray units. In any unit, the program which yields the most accurate compensation is selected during calibration of the x-ray unit.

It will be evident to those skilled in the art that the concept of storing the switching pattern in PROM required to obtain selected kilovoltages for various battery voltage levels is applicable to systems where an ordinary transformer is used which has its primary entirely isolated from its secondary instead of using an autotransformer where at least a part of the primary and secondary windings are the same. Moreover, the tap switches could either be in the primary or seconary windings in a system which uses an ordinary transformer to step up the voltage which is supplied by the inverter.

Figure 2:
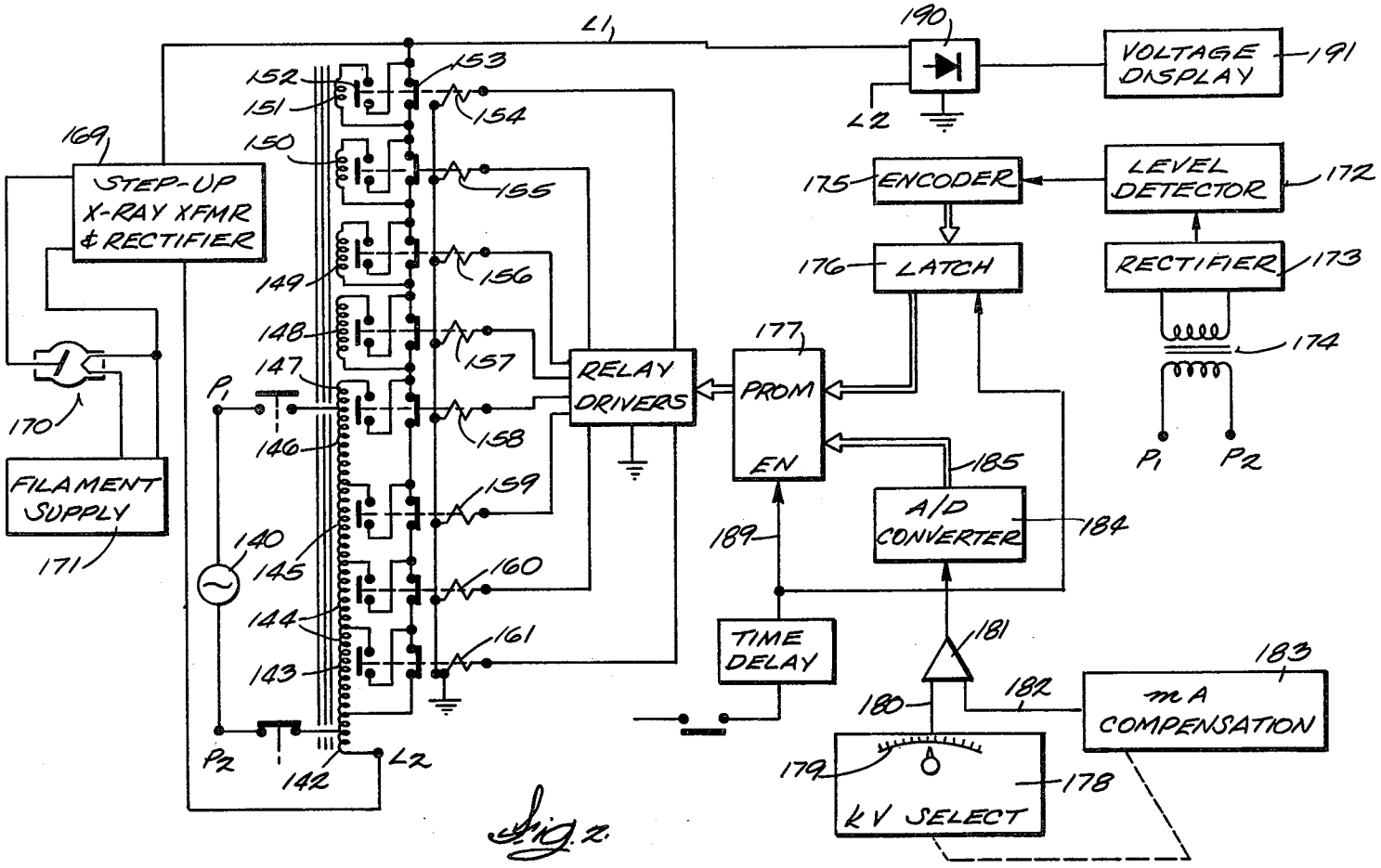
FIG. 2 is a block and partially schematic diagram of an x-ray unit voltage source variation compensating system which derives its power from alternating current power lines.

An alternative embodiment of the source voltage variation compensating system is depicted in FIG. 2. The circuitry is for a dignostic x-ray system which, instead of being powered by a battery as in the case of FIG. 1, it is powered from the ac power lines of a building.

In FIG. 2, the input terminals which are connected to the power line are marked P1 and P2 and the ac source is indicated by the reference numeral 140. As in the previous embodiment, an autotransformer 141 is tapped for developing an output voltage for being supplied to an x-ray transformer which voltage agrees with the selected kv despite the voltage of the source being above or below normal.

The autotransformer has a plurality of winding sections marked 142–151. Each winding section has a pair of jointly co-acting normally closed and normally open switch contacts associated with it such as the pair marked 152 and 153. Various switch contact pairs are operated by electroresponsive means such as the group of relay coils 154–161. The autotransformer, switch contact and relay arrangements are basically similar to those which were described in connection with the FIG. 1 embodiment. The number of turns in the transformer winding sections are equivalent to binary values. For instance, winding section 148 may have eight turns, section 149 may have four turns, section 150 may have two turns, and section 151 may have one turn. Thus, any combination of voltage values between 0 and 16 is obtainable with this group of coils. Windings 143, 144, 145 and 146 each have a number of turns equal to the sum of the number of turns in the winding group 148–151. The output terminals of the transformer are marked L1 and L2. As in the previously discussed embodiment, the voltage, which is compensated for source voltage variations, if any, is applied from transformer terminals L1 and L2 to step up x-ray transformer and rectifier assembly 169 which delivers power to the anode-to-cathode circuit of an x-ray tube 170. The x-ray tube current control is symbolized by a block marked 171 which need not be described in detail since those skilled in the x-ray control circuitry art can use any of a variety of conventional current control systems with which they are familiar.

In the FIG. 2 embodiment, a source voltage level detector of comparator 172 which is similar to level detector 95 in FIG. 1 embodiment may be used to determine the present level of the power supply voltage across input terminals P1 and P2. There is a dc input to the level detector as in the previously discussed embodiment which is obtained from a rectifier circuit 173 which is supplied from the secondary of a step-down or isolating transformer 174 whose primary windings connect to input power line terminals P1 and P2 as indicated in the drawing.

As in the FIG. 1 embodiment, analog signals outputted by the level detector and representing the source voltage level are converted or encoded into a multiple bit code by an encoder 175. A three-bit code is usually satisfactory, however, if closer compensation is required or smaller line voltage variations are to be compensated, then the level detector range has to be expanded and the encoder has to be adapted to convert a larger number of input voltage steps to a code which represents these additional steps with a number of bits in excess of three. As is evident, 16 different input voltage levels could be represented by a four-bit code and 32 levels could be represented by a five-bit code.

The code word corresponding with the present source voltage level is delivered to a latch 176 as in the previous embodiment. This code is part of an address to a selected voltage compensating program which is stored in a PROM 177. As in the previous embodiment, the other part of the address represents the kilovoltage which is set by the operator before making an x-ray exposure. This part of the code, as in the previous case, is developed with a kv selector 178 which has a rotatable knob with a pointer pointing toward a scale 179 which represents selected voltage. The knob rotates a potentiometer, not visible, which outputs an analog signal on a line 180 that constitutes one input to a summing amplifier 181. Another input line 182 to amplifier 181 provides a signal from an mA compensation circuit represented by the block 183. Circuits of this kind are known in the x-ray art and need not be described in detail. It is sufficient to say that the mA compensation circuit causes the kilovoltage indicative signal to be modified to account for differences between the selected and actual kilovoltage produced such as would result from differences in circuit voltage drops with difference x-ray tube load currents.

The analog signal representing selected x-ray tube anode kv and the signal for mA compensation are summed by amplifier 181 and delivered to an analog-to-digital code converter 184 which encodes the analog signal to a multiple bit digital code word which forms the second part of the address to PROM and is delivered thereto by way of a bus 185. When the PROM 177 is addressed by the combined code word consisting of a group of bits representative of source voltage and another group of bits representative of selected and current compensated kv, the PROM outputs the proper combination of low and high bits to the relay drivers 186 for causing the relays 154–161 to produce the proper switch contact opening and closing pattern for developing a voltage on terminals L1 and L2 that will result in the selected kv being applied to the anode of x-ray tube 170.

When the system in FIG. 2 is in the preparation stage for making an x-ray exposure and immediately before the exposure is made, a switch contact 187 is closed to activate a time delay device 188 which produces an output signal on a line 189 that causes latch 176 to hold the code representative of the source voltage at the moment so that there can be no change until after the x-ray exposure is completed. The same signal enables the PROM at that time to output whatever compensating code results from the existing address codes so that the relays 154–161 have time to operate and make the proper switch pattern selection before the exposure is initiated.

In FIG. 2, a rectifier 190 is connected across transformer output terminals L1 and L2. The dc output voltage of this rectifier drives a voltage display 191 which is scaled up to present with a 7-segment display the actual kilovoltage that is to be applied to the x-ray tube prior to the exposure.

PROM 177 is programmed by the method described in connection with the FIG. 1 embodiment except that an ac input or source voltage is varied incrementally and the proper relay operation pattern required to produce a particular kilovoltage is noted.

In summary two source voltage compensation systems have been described wherein each output kv setting and source voltage combination is permanently stored and each is independent of all others so that all factors which might affect output voltage at particular x-ray tube kv and current settings and source voltages are accounted for even though the affecting factors are not even known.

We claim:

1. A regulator for providing a voltage to an x-ray tube power supply which results in a selected voltage being supplied to an x-ray tube independent of variations in the voltage of a power source, comprising:

a transformer having primary winding input terminals, means for coupling said input terminals to said power source, said transformer having output terminals for being coupled to said x-ray tube power supply, said transformer including a plurality of winding sections for being connected selectively in a series circuit between said output terminals, a plurality of pairs of tap switch means operable to connect selected ones of said winding sections in said series circuit and to exclude selected sections from said circuit to thereby enable obtaining the output voltage between said output terminals that results in the selected voltage on the tube, electroresponsive switch operating means for the respective tap switch pairs, voltage level detector means for sensing voltage representative of said power source voltage, said detector means being operative to produce analog signals corresponding to said source voltage, first encoder means operative to convert said analog signals to first multiple-bit code words representative of the prevailing source voltage level, said first words respectively constituting part of an address, means for selecting the voltage level desired to be applied to said x-ray tube by said x-ray tube power supply as a result of the transformer output voltage applied to said power supply, second encoder means for producing second multiple-bit code words representative of said desired voltage level, said second code words, respectively, constituting another part of said address, read-only memory means having output means and having input means for receiving a combination binary address composed of the code bits representative of the power source voltage and the code bits representative of the desired x-ray tube voltage, said read-only memory means being operative to convert each address code into binary code signal on its output means representative of the tap switch operating means which must be activated to obtain the desired transformer output voltage for each source voltage as defined by the combination address code, and drive means having input means for said binary code signal and output means coupled to said respective electroresponsive switch operating means for operating said switches in correspondence with the level of the bits in said code signal.

2. The apparatus as in claim 1 wherein said means for coupling said transformer input terminals to the power source in a dc to ac inverter and the power source is a battery.

3. The apparatus in any of claim 1 or 2 including a latch device having input means for receiving the multiple-bit code words from said first encoder means and having output means coupled to said read-only memory, said latch being operative to hold and prevent change of the code word representative of power source voltage during the time when voltage is being applied to the x-ray tube for making an x-ray exposure.

4. The apparatus as in claim 1 wherein:

said means for selecting the voltage level desired to be applied to said x-ray tube is operative to produce one analog signal corresponding to the nominal selected voltage, means for producing another analog signal representative of the amount said nominal selected voltage must be altered to compensate for voltage variations that depend on the current selected to flow through the x-ray tube when voltage is being applied to the tube for making an x-ray exposure, summing amplifier means operative to sum the one and the other signals to produce an analog signal for being encoded in binary digital form by said second encoder means as part of the address to said read-only memory.

5. The apparatus as in claim 1 wherein:

said read-only memory is programmed to output binary code words corresponding with the switches for said transformer windings which are to be open and closed for said transformer to provide a measured voltage to said x-ray tube power supply and a measured current to the tube and to respond to addresses corresponding to the power source voltage level and selected voltage at the time the voltage for the tube and its current are measured, to thereby compensate for all variables which might affect the correspondence between selected voltage and the x-ray tube applied voltage when the x-ray tube is energized.

6. A method of compensating the voltage applied between the anode and cathode of an x-ray tube for power source voltage variations, comprising:

providing a transformer having its input supplied from the power source and having an output circuit comprised of a plurality of windings for being connected with switches in various combinations to provide corresponding voltages to another step-up transformer which supplies the anode-to-cathode voltage to the x-ray tube, performing the steps of adjusting the power source to provide a particular voltage and opening and closing the switches in various combinations while making a series of x-ray exposures with the x-ray tube conducting for each combination and recording the data indicative of the voltage actually applied to the x-ray tube and the source voltage, repeating said steps at incremental changes in the source voltage through at least the expected range of source voltage variations, then programming a read-only memory so it will respond to binary coded addresses representative of particular source voltages and related x-ray tube applied voltages, respectively, corresponding with said data by producing a digital code word representative of the switch combination existing when the data was obtained, developing addresses for the read-only memory representative of prevailing source voltage and desired applied voltage for addressing the read-only memory to produce the digital code word representative of the switch combination, and providing means which respond to said digital words by establishing the switch combination.

* * * * *